US005702029A

United States Patent [19]

Yang

[11] Patent Number: 5,702,029

[45] Date of Patent: Dec. 30, 1997

[54] DISPOSABLE CUP DISPENSER

[76] Inventor: Yi-Teh Yang, No. 44, Lane 19, Chi-Lung Rd., Ta-Li City, Taichung Hsien, Taiwan

[21] Appl. No.: 635,726

[22] Filed: Apr. 22, 1996

[51] Int. Cl.[6] ..... B65H 3/28

[52] U.S. Cl. ..... 221/221; 221/303

[58] Field of Search ..... 221/221, 268, 221/276, 251, 223, 233, 303, 255, 282

[56] References Cited

U.S. PATENT DOCUMENTS 3,768,694 10/1973 Miller ..... 221/221
4,741,458 5/1988 Odorici ..... 221/221

*Primary Examiner*—Kenneth Noland
*Attorney, Agent, or Firm*—Bacon & Thomas

[57] ABSTRACT

A disposable cup dispenser comprises a fastening frame, an upper locating frame, a lower locating frame, a cup container, a dispensing plate, and a support rod. The dispensing plate is fastened with the bottom end of the cup container such that only one cup is dispensed at a time. The cups are dispensed upside down and caught by the support rod.

1 Claim, 8 Drawing Sheets

PRIOR ART FIG 1

DISPOSABLE CUP DISPENSER

FIELD OF THE INVENTION

The present invention relates generally to a disposable cup, and more particularly to a disposable cup dispenser.

BACKGROUND OF THE INVENTION

As shown in FIG. 1, a disposable cup dispenser of the prior art is of a hollow cylindrical construction and is provided in the inner wall of the bottom thereof with a retaining edge capable of catching the brim of a disposable cup which is the bottommost one of a stack of disposable cups kept in the hollow interior of the dispenser. The disposable cups can be thus dispensed one by one by a person holding and pulling the cup body to cause the brim of the cup to disengage the retaining edge of the dispenser.

Such a prior art disposable cup dispenser as described above is defective in design in that the bottommost cup of a stack of cups is subjected to the heavy weight of the cups stacked thereon and is therefore vulnerable to falling on the floor by itself. In addition, two or more cups can be dispensed simultaneously and accidentally by a person who happens to pull the bottommost cup with an excessive pulling force.

SUMMARY OF THE INVENTION

It is therefore the primary objective of the present invention to provide a disposable cup dispenser devoid of the deficiencies of the prior art disposable cup dispenser described above.

The features of the present invention will be readily understood upon a thoughtful deliberation of the following detailed description of the present invention in conjunction with the accompanying drawings.

DETAILED DESCRIPTION OF THE EMBODIMENT

Figure 1:
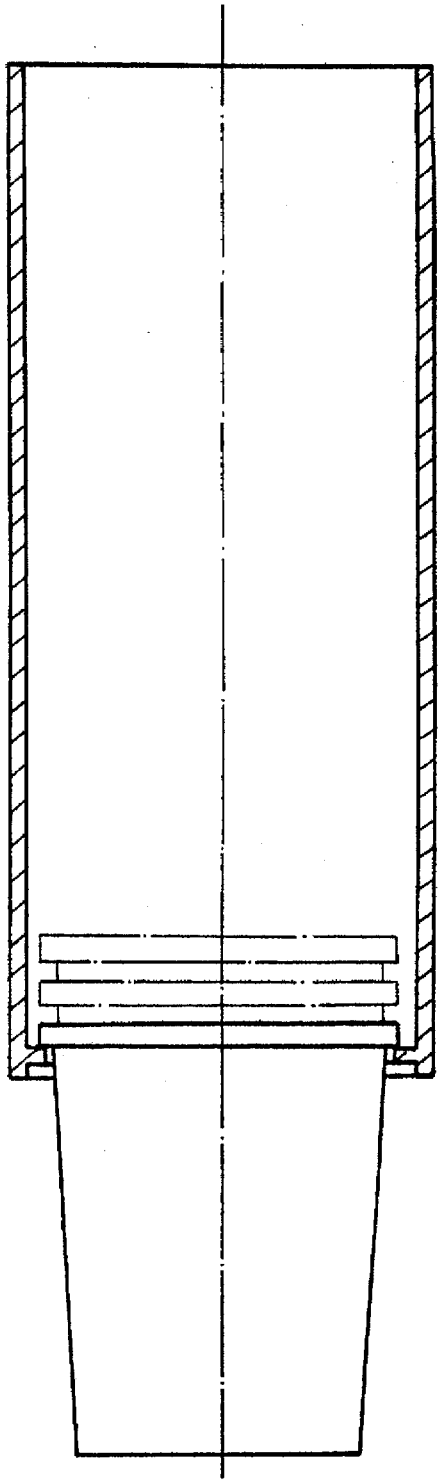
FIG. 1 shows a schematic view of a disposable cup dispenser of the prior art.
Figure 2:
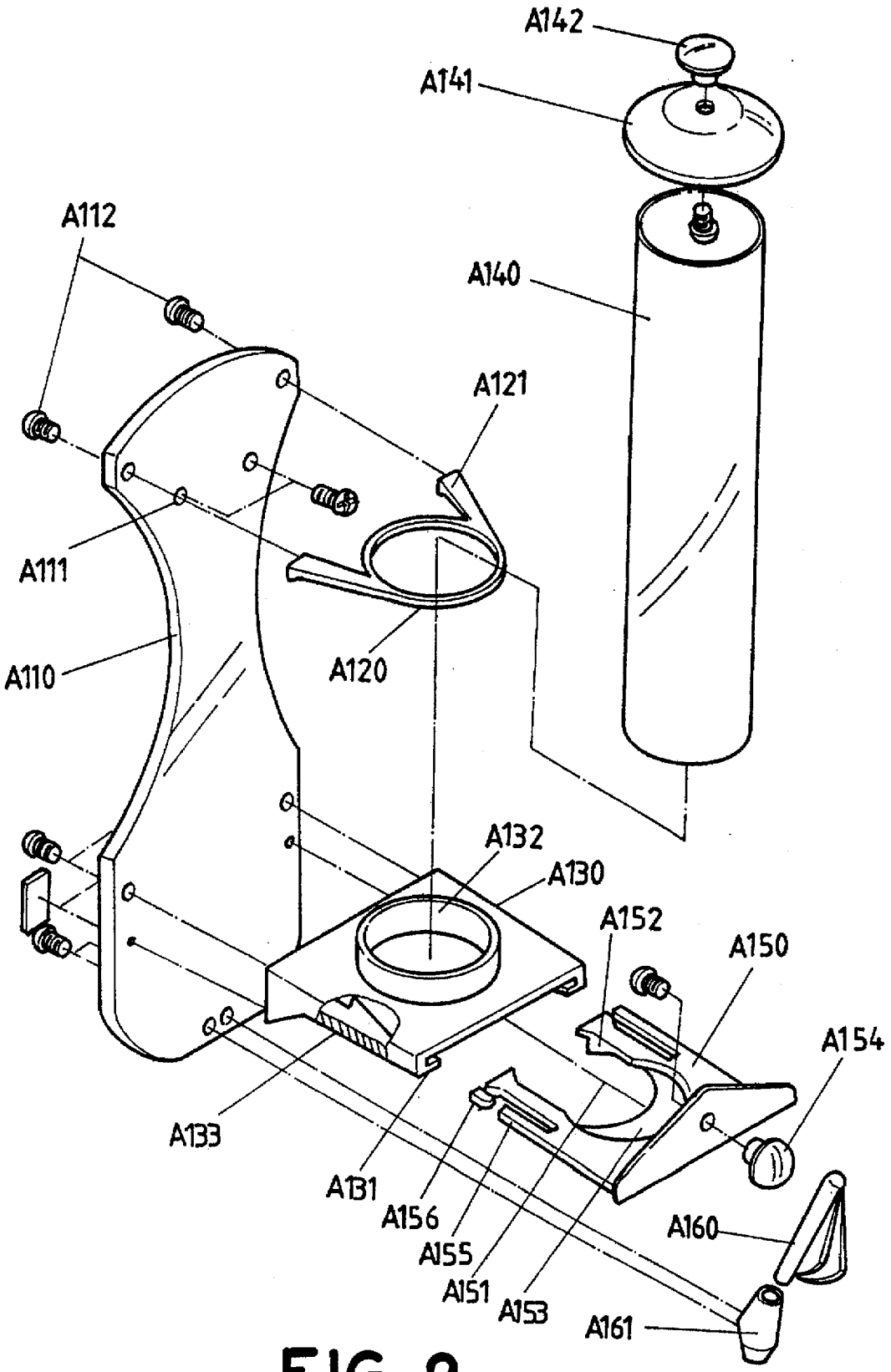
FIG. 2 shows an exploded view of a disposable cup dispenser of the present invention.
Figure 3:
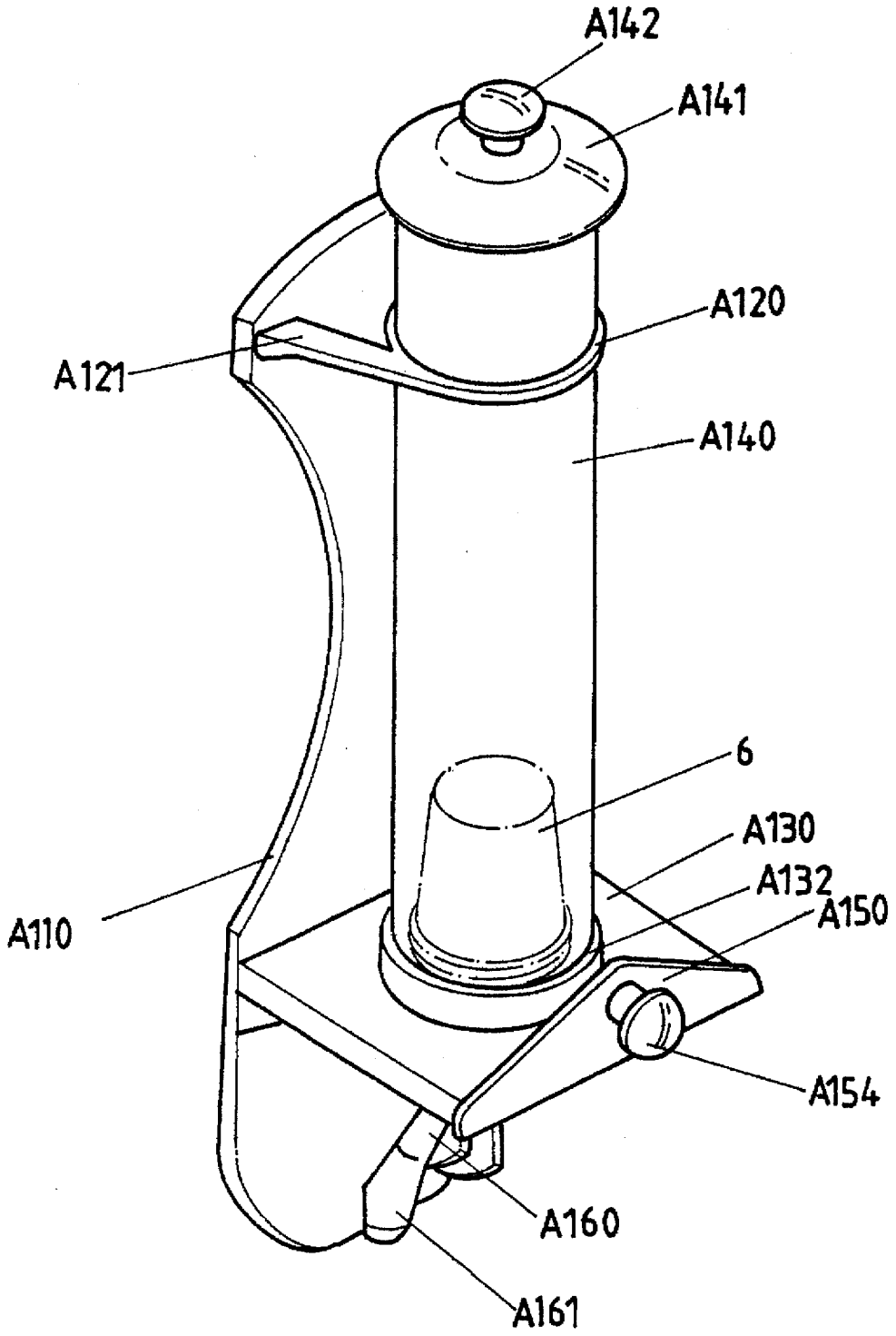
FIG. 3 shows a perspective view of the disposable cup dispenser of the present invention in combination.
Figure 4:
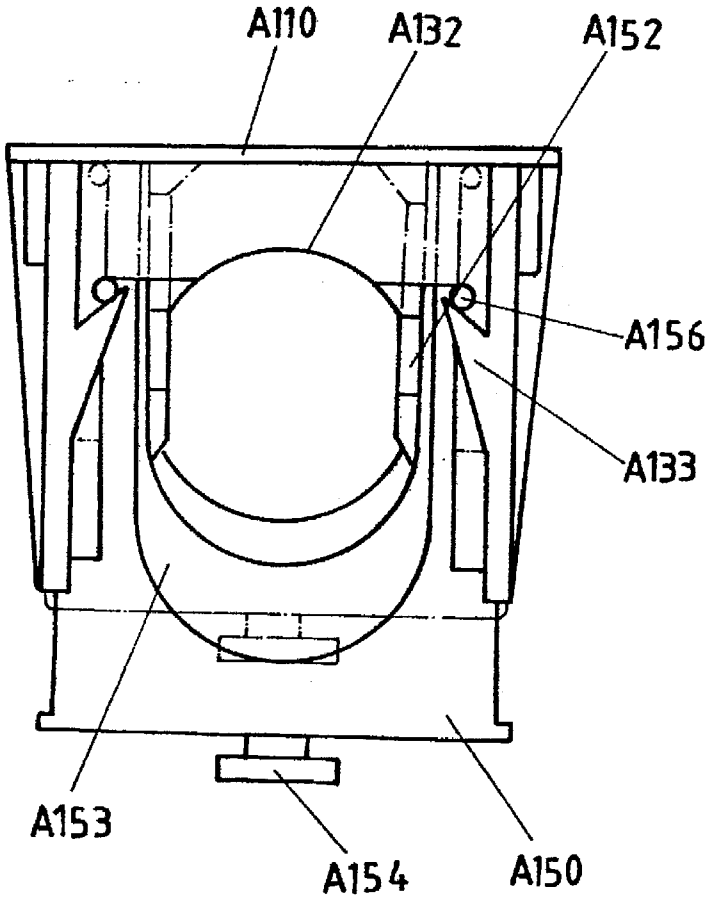
FIG. 4 is a schematic view illustrating the action of a dispensing plate of the present invention.
Figure 5:
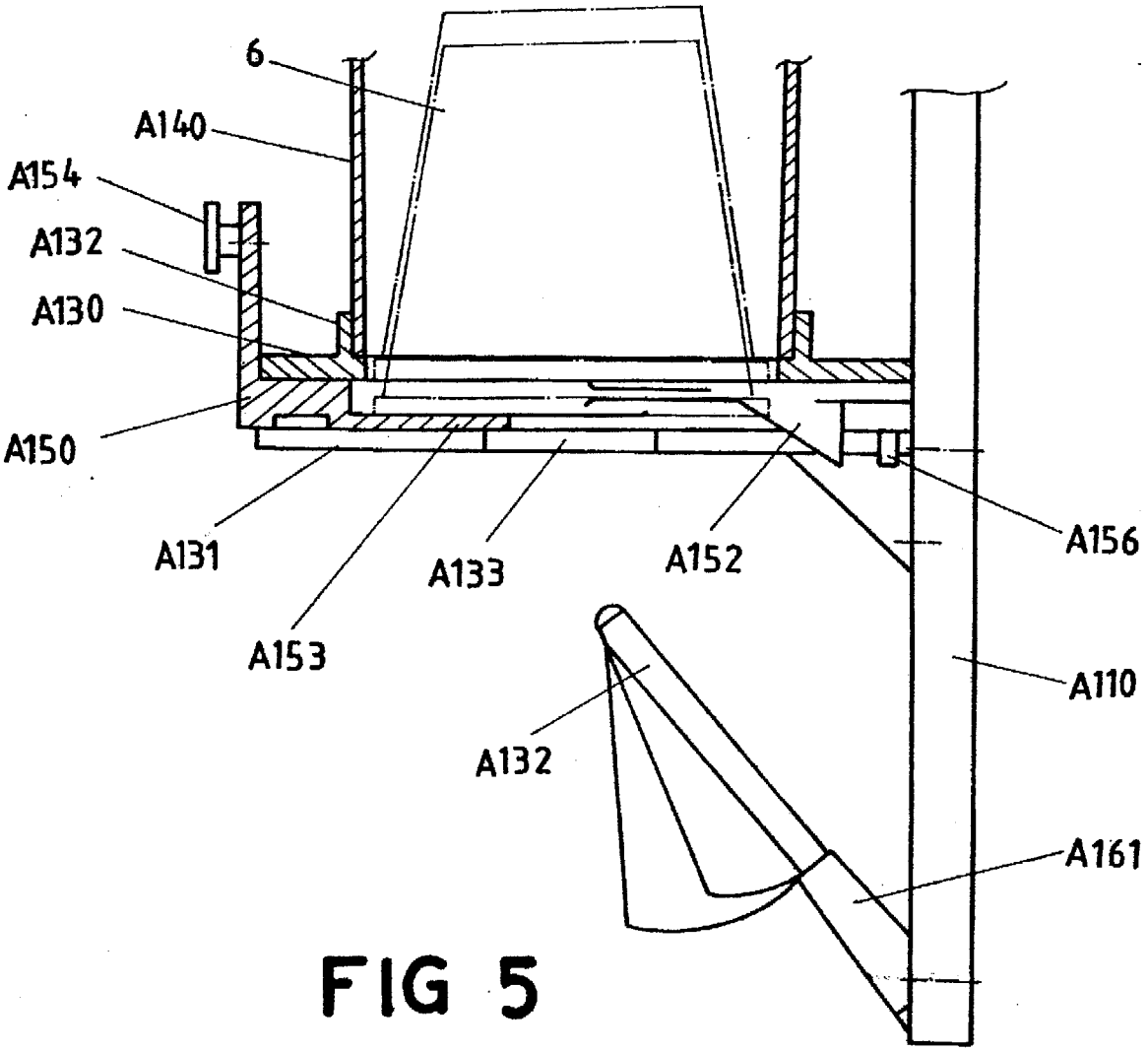
FIG. 5 is a schematic view illustrating the relationship between the disposable cup and the dispensing plate of the present invention.
Figure 6:
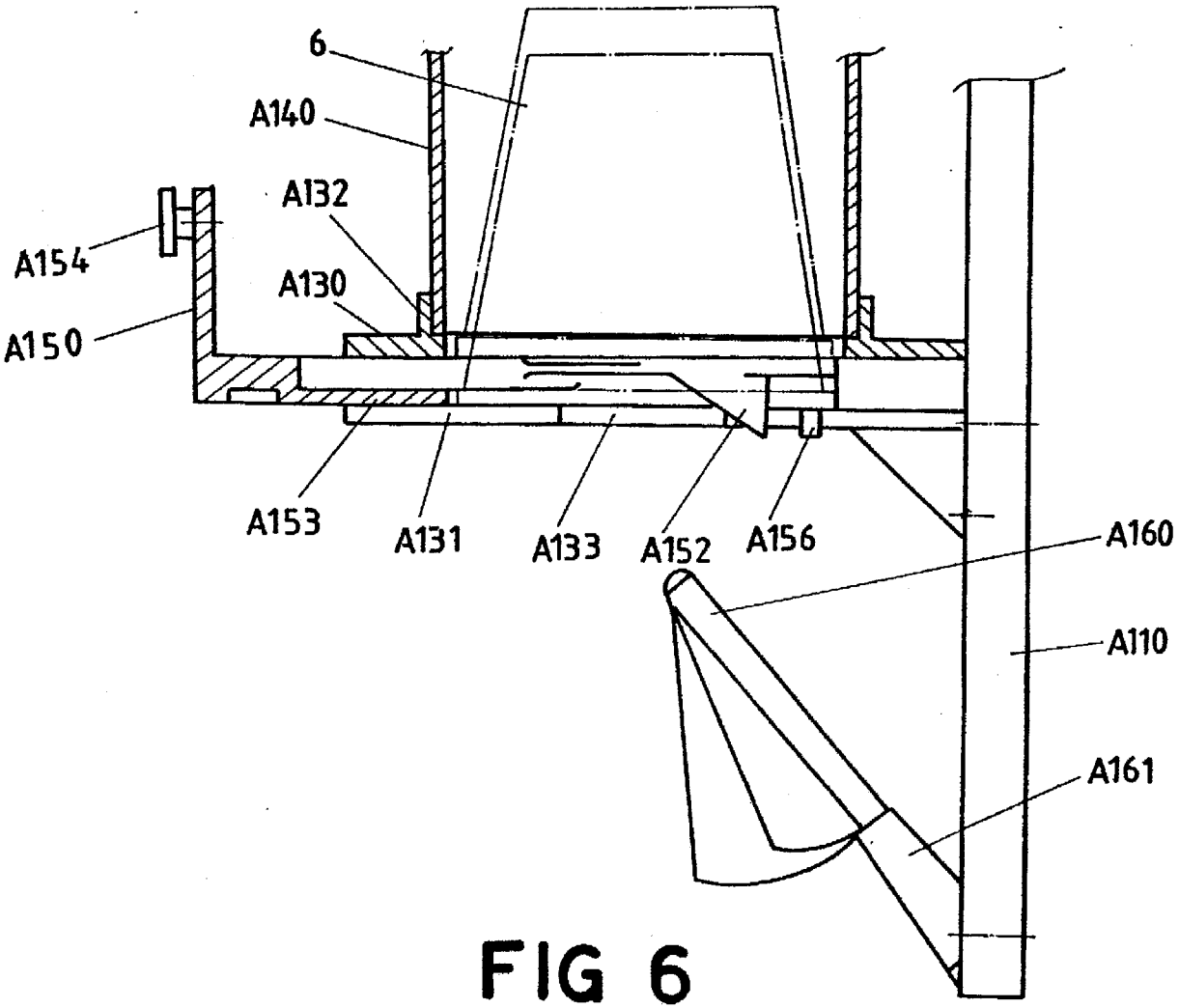
FIG. 6 is a schematic view illustrating the dispensing plate of the present invention.
Figure 7:
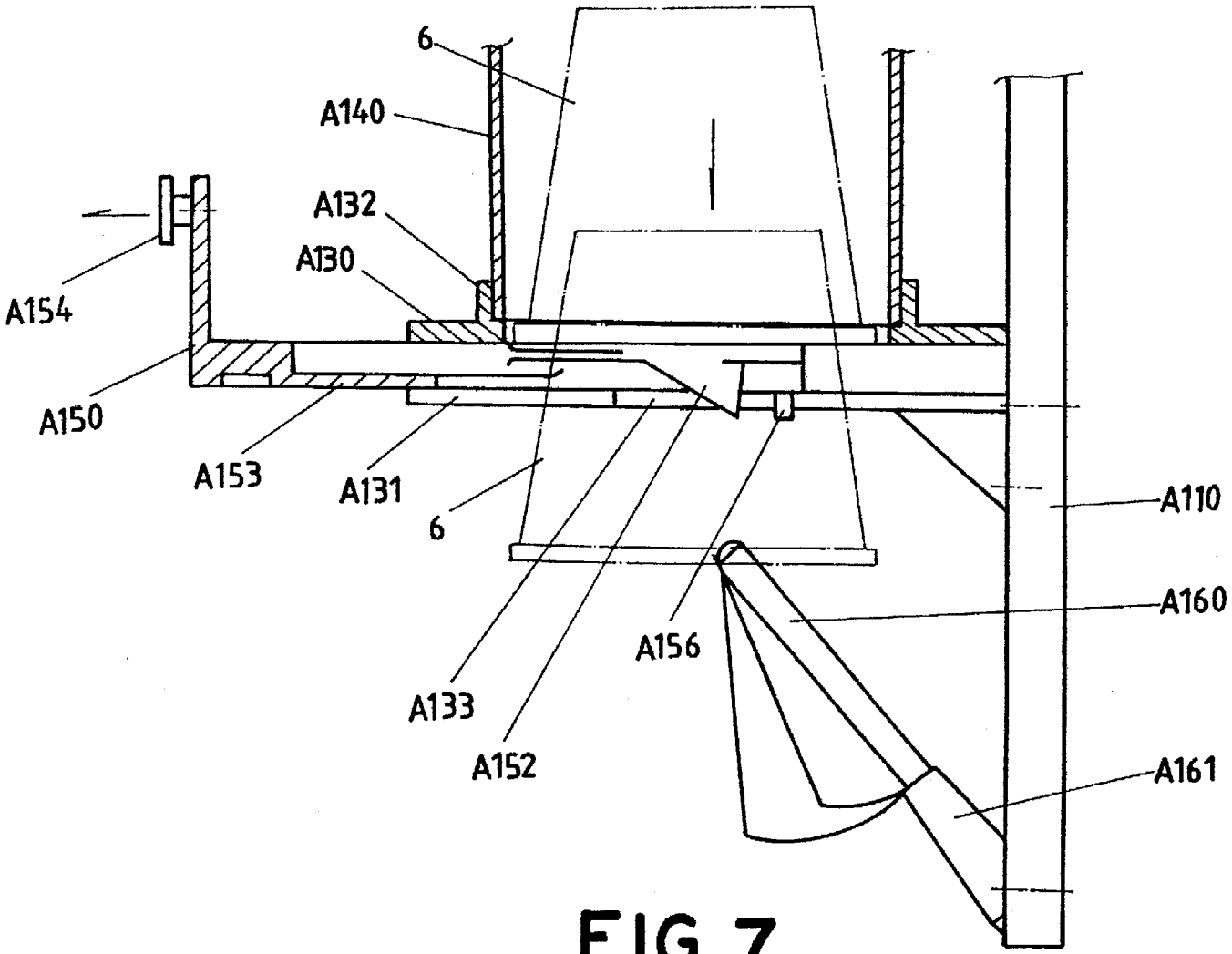
FIG. 7 is a schematic view illustrating the dispensing of a disposable cup by the disposable cup dispenser of the present invention.

As shown in FIGS. 2 and 3, a disposable cup dispenser embodied in the present invention is composed of a fastening frame 110, an upper locating frame 120, a lower locating frame 130, a cup container 140, a dispensing plate 150, and a support rod 160.

The fastening frame 110 is provided with a plurality of fastening holes 111 and fastening screws 112 for fastening the frame 110 to a wall.

The upper locating frame 120 is fastened with the frame 110 and is provided with two support arms 121 and a locating ring fastened between the arms 121.

The lower locating frame 130 is provided in the underside thereof with two retaining slots 131 opposite in location to each other and is further provided on the upper side thereof with a through hole having a locating ring 132 attached thereto such that the locating ring 132 is corresponding in location to the locating ring of the upper locating frame 120. The retaining slots 131 are provided respectively with a retaining block 133. The lower locating frame 130 is fastened with the frame 110 by means of screws engaging a flap 134 of the lower locating frame 130 and the frame 110.

The cup container 140 of a cylindrical construction is held securely by the locating rings of the upper locating frame 120 and the lower locating frame 130. The cup container 140 has a cup 141 having a retaining body 142 which is detachably fastened thereto.

The dispensing plate 150 is slidably disposed in the retaining slots 131 of the lower locating frame 130 and is provided with a cut 151, two guide blocks 152, a retaining edge 153, a pull handle 154, and two elastic blocks 155 having a projection 156.

The support rod 160 is provided with a base 161 which is fastened with the frame 110 by means of screws.

Figure 8:
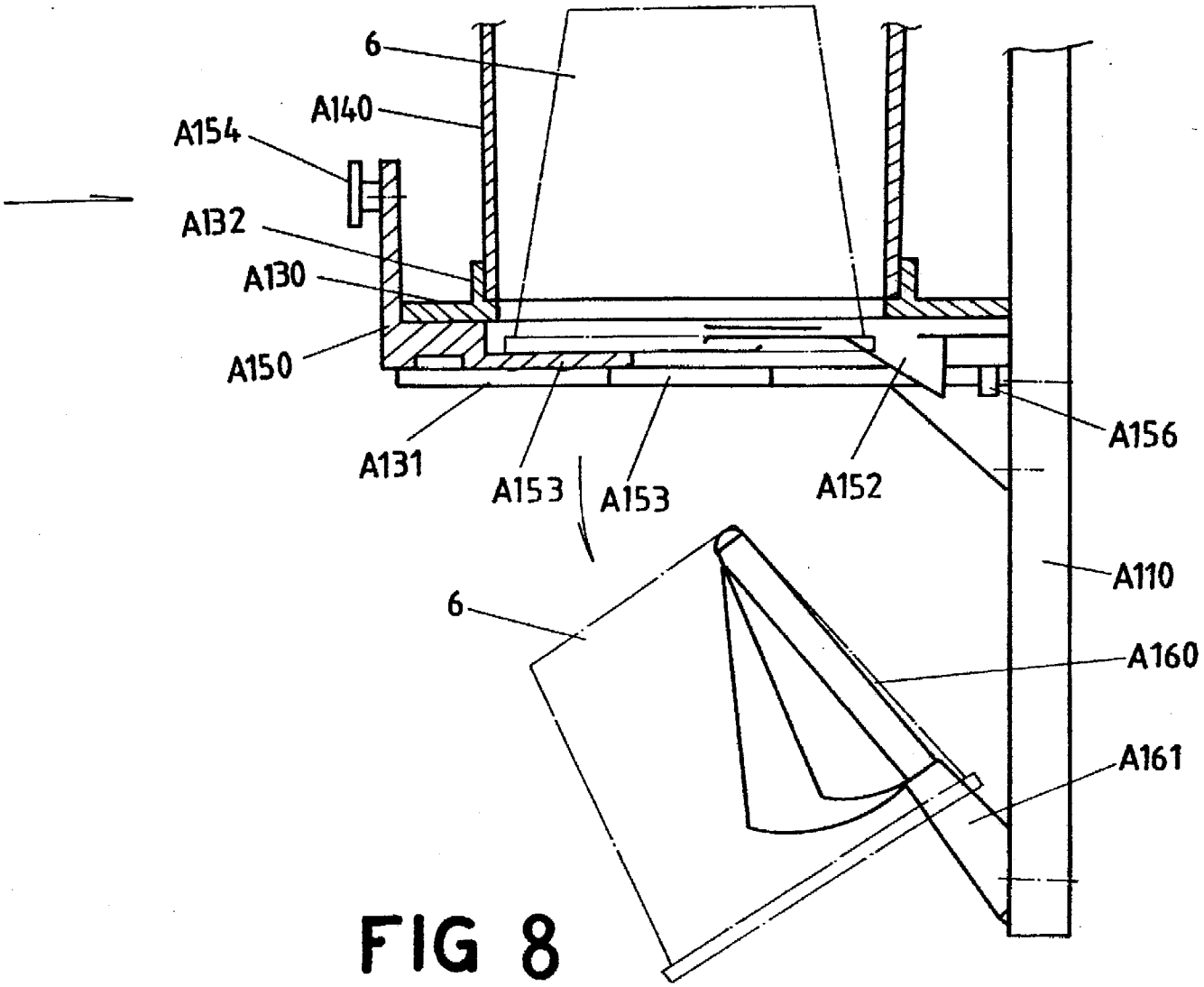
FIG. 8 shows another schematic view illustrating the dispensing plate of the present invention at work.

In operation, the dispensing plate 150 is pulled out with hand holding the pull handle 154 such that the projection 156 of the dispensing plate 150 is in contact with the retaining block 133 of the lower locating frame 130 so as to dispense a cup 6 which is the bottommost one of a stack of cups kept in the cup container 140. The cup 6 is dispensed upside down and is caught by the support rod 160, as shown in FIG. 8.

It must be noted here that the containing block 133 of the retaining slot 131 is slanted so as to prevent the projection 156 of the dispensing plate 150 from being pulled out of the retaining slot 131 when the dispensing plate 150 is pulled with an excessive force.

The embodiment of the present invention described above is to be regarded in all respects as being merely illustrated and not restrictive. Accordingly, the present invention may be embodied in other specific forms without deviating from the spirit thereof. The present invention is therefore to be limited only by the scopes of the following appended claim.

What is claimed is:

1. A disposable cup dispenser, which comprises:

a fastening frame provided with a plurality of fastening holes engageable with fastening screws for fastening said fastening frame with a wall;

an upper locating frame fastened with said fastening frame and provided with a locating ring;

a lower locating frame provided in an underside thereof with two retaining slots opposite in location to each other and having respectively a retaining block, said lower locating frame further provided in an upper side thereof with a through hole having a locating ring attached thereto such that said locating ring of said through hole of said lower locating frame is corresponding in location to said locating ring of said upper locating frame, said lower locating frame having a flap which is fastened with said fastened frame;

a cup container of a cylindrical construction and held securely by said locating ring of said upper locating frame and said locating ring of said lower locating frame, said cup container having a cap with a retaining body;

a dispensing plate disposed slidably in said retaining slots of said lower locating frame and provided with a cut, two guide blocks, a retaining edge, a pull handle, and two elastic blocks having a projection; and a support rod provided with a base which is fastened with said fastening frame, said support rod intended for catching a cup which is dispensed upside down.

* * * * *